US010433402B2

(12) United States Patent
Chang

(10) Patent No.: US 10,433,402 B2
(45) Date of Patent: Oct. 1, 2019

(54) REMOTE SWITCH DEVICE AND REMOTE CONTROL ELECTRIC DEVICE

(71) Applicant: Shih-Yang Chang, Taichung (TW)

(72) Inventor: Shih-Yang Chang, Taichung (TW)

( * ) Notice: Subject to any disclaimer, the term of this patent is extended or adjusted under 35 U.S.C. 154(b) by 367 days.

(21) Appl. No.: 15/408,490

(22) Filed: Jan. 18, 2017

(65) Prior Publication Data

US 2017/0207047 A1 Jul. 20, 2017

(30) Foreign Application Priority Data

Jan. 20, 2016 (TW) ..... 105200834 U
Mar. 18, 2016 (TW) ..... 105203822 U
Oct. 25, 2016 (TW) ..... 105134403 A

(51) Int. Cl.
*H05B 37/02* (2006.01)
*G08C 19/28* (2006.01)
*G08C 17/02* (2006.01)

(52) U.S. Cl.
CPC ..... *H05B 37/0272* (2013.01); *G08C 19/28* (2013.01); *G08C 17/02* (2013.01)

(58) Field of Classification Search
CPC ..... H05B 37/0272
See application file for complete search history.

(56) References Cited

U.S. PATENT DOCUMENTS

2008/0157604 A1* 7/2008 You ..... G08C 17/02 307/114
2013/0082605 A1* 4/2013 Wu ..... H05B 37/0272 315/130
2016/0126031 A1* 5/2016 Wootton ..... H05B 39/02 361/211
2016/0255702 A1* 9/2016 Thompson ..... H01H 9/0271 315/133
2017/0086281 A1* 3/2017 Avrahamy ..... C02F 1/42

* cited by examiner

*Primary Examiner* — Rexford N Barnie
*Assistant Examiner* — David A Shiao
(74) *Attorney, Agent, or Firm* — Birch, Stewart, Kolasch & Birch, LLP

(57) ABSTRACT

A remote switch device includes a first port, a second port and a third port. One of the first and second ports is coupled to a first power circuit through an external switch, and the other one is coupled to the first power circuit. The third port is coupled to a second power circuit through a load. The remote switch device switches, upon any one of receipt of a wireless control signal that indicates a switching operation and detection of switching of the external switch, from one of a conducting state and a non-conducting state to the other one of the conducting state and the non-conducting state, thereby permitting or not permitting electrical power transmission from the first power circuit to the second power circuit.

20 Claims, 14 Drawing Sheets

REMOTE SWITCH DEVICE AND REMOTE CONTROL ELECTRIC DEVICE

CROSS-REFERENCE TO RELATED APPLICATION

This application claims priority of Taiwanese Patent Application No. 105200834, 105203822 and 105134403, respectively filed on Jan. 20, Mar. 18 and Oct. 25, 2016.

FIELD

The disclosure relates to a switch device, and more particularly to a remote switch device.

BACKGROUND

Traditionally, for electric devices that have no remote control function, a user needs to approach the electric device or a switch thereof for turning the electric device on or off, which is rather inconvenient. Therefore, remote switch devices are developed for providing the remote control function to such electric devices. Installation of a conventional remote switch device may be realized by externally plugging the same into an electrical outlet to serve as an adapter, or by directly replacing the electrical outlet therewith, thereby achieving remote control of an electric device that is coupled to the conventional remote switch device.

However, the conventional remote switch device is not suitable for electric devices of which wirings are usually hidden in ceilings and/or walls and which are turned on/off through a manual switch installed to a wall, such as lamp devices, ceiling fan devices, etc. In a case of using the conventional remote switch device to achieve remote control of this kind of electrical devices, the manual switch may need to be directly replaced by the conventional remote switch device, which would become the only way to turn on/off the electric device, making the user unable to control the electric device when the remote switch device malfunctions.

SUMMARY

Therefore, an object of the disclosure is to provide a remote switch device and a remote control electric device that can alleviate at least one of the drawbacks of the prior art.

According to the disclosure, the remote switch device includes a first port, a second port, a third port, a switch unit, a wireless module and a control unit. One of the first and second ports is to be coupled to a first power circuit through an external switch when the external switch conducts, and the other one of the first and second ports is to be coupled to the first power circuit. The third port is to be coupled to a second power circuit through a load. The switch unit includes a first switch module and a second switch module. The first switch module is coupled to the second port. The second switch module is coupled to the first port, the third port and the first switch module. The wireless module is configured to receive a wireless control signal that indicates a switching operation, and to output a switching signal according to the wireless control signal. The control unit is coupled to the wireless module for receiving the switching signal, is coupled to at least the second switch module for controlling switching operation thereof, and is configured to detect a state of the external switch. When the remote switch device is in a first operation state, the control unit controls the switch unit to switch, upon any one of receipt of the switching signal and detection of switching of the external switch, from one of a conducting state and a non-conducting state to the other one of the conducting state and the non-conducting state. In the conducting state, the switch unit is controlled by the control unit to permit transmission of electrical power between the first and second power circuits through the first and second switch modules and the load. In the non-conducting state, the switch unit is controlled by the control unit to not permit transmission of electrical power between the first and second power circuits therethrough.

According to the disclosure, the remote control electric device is adapted to be removably coupled to an electric power unit that includes an external switch, a first power circuit coupled to the external switch, and a second power circuit. The remote control electric device includes a remote switch device part and an electric device part. The remote switch device part is configured as the remote switch device of this disclosure. The electric device part has a first terminal to be coupled to the second power circuit, and a second terminal coupled to the third port of the remote switch device part, and serves as the load of the remote switch device of this disclosure.

BRIEF DESCRIPTION OF THE DRAWINGS

Other features and advantages of the disclosure will become apparent in the following detailed description of the embodiment (s) with reference to the accompanying drawings, of which.

DETAILED DESCRIPTION

Figure 1:
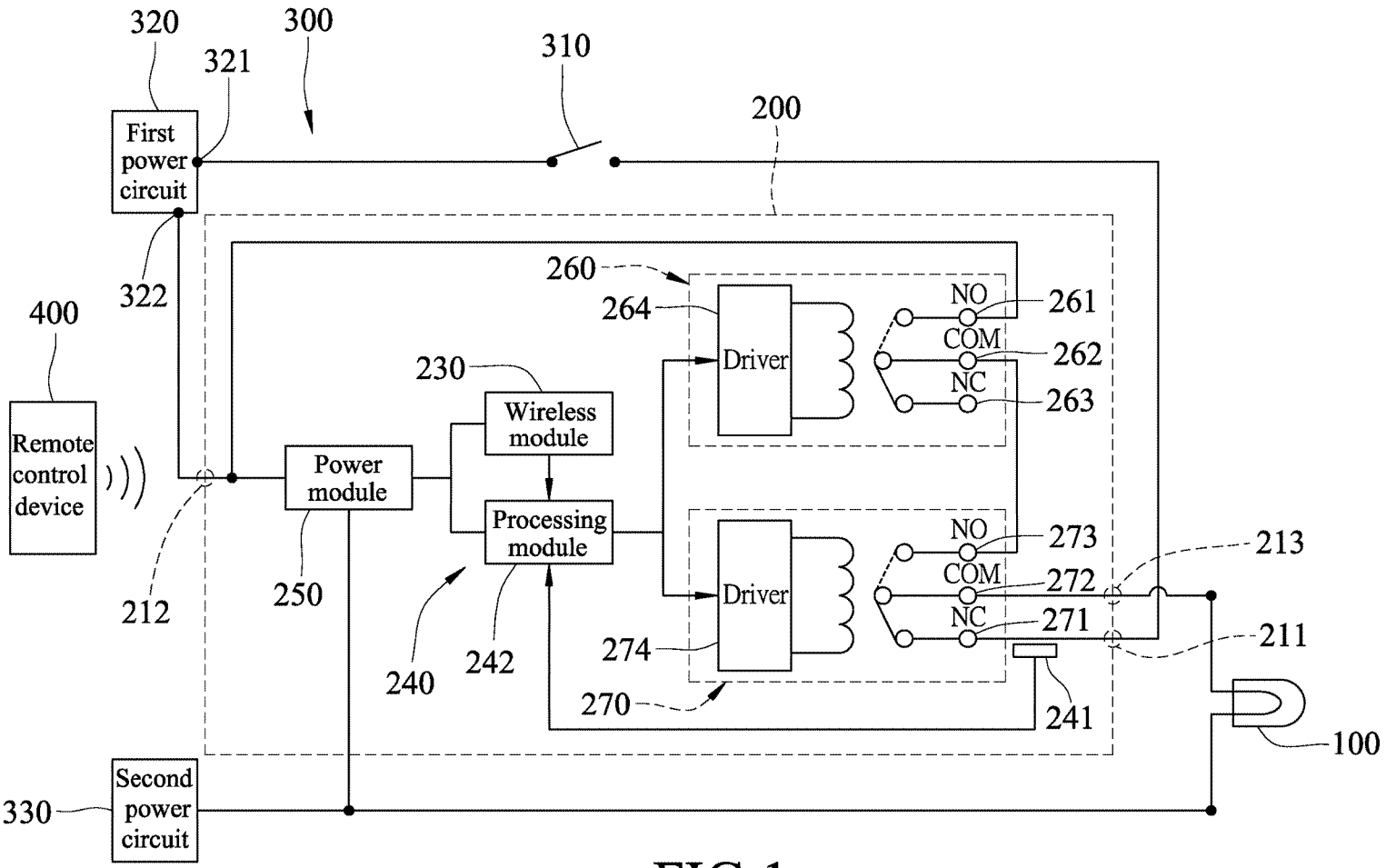
FIGS. 1 to 7 are circuit block diagrams respectively illustrating first to seventh embodiments of the remote control electric device operating in an abnormal state according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, the first embodiment of the remote control electric device according to this disclosure is removably coupled to an electric power unit 300, and can be controlled using a remote control device 400 that is capable of transmitting a wireless control signal. The electric power unit 300 includes an external switch 310, a first power circuit 320 coupled to the external switch 310, and a second power circuit 330 that cooperates with the first power circuit 320 to provide electrical power. It is noted that the remote control electric device may include the external switch 310 when being sold as commodity in a store.

In this embodiment, the electric power unit 300 is a single-phase three-wire system that is commonly used in mains electricity. When the electric power unit 300 provides a voltage of 110V, the first and second power circuits 320, 330 may refer to a line wire circuit and a neutral wire circuit, respectively; and when the electric power unit 300 provides a voltage of 220V, the first and second power circuits 320, 330 may refer to different line wires, so electrical power may be acquired by connections to the first and second power circuits 320, 330. In other embodiments, the electric power unit 300 may be a three-phase three-wire or three-phase four-wire system, and this disclosure is not limited thereto. The external switch 310 may be a single-pole, single-throw (SPST) switch that is commonly installed to a wall for manually turning on/off an electric device, such as a lamp device, a ceiling fan, etc., or a remote controllable switch which is installed in an electric device, such as an air conditioner. It is noted that the disclosure is not limited to the type of the external switch 310.

The remote control electric device includes a part of a remote switch device 200, and a part of an electric device that is coupled to the second power circuit 330, and that serves as a load 100 of the remote switch device 200.

In this embodiment, the load 100 is, but not limited to, a lamp device, or may be an electric fan device or other kinds of electric device. The load 100 may be an ordinary electric device that is coupled between the first and second power circuits 320, 330 only through the external switch 310 originally, so that a user may turn on/off the electric device through operating the external switch 310. The remote switch device 200 may be additionally installed by connecting a first terminal of the load 100 that is originally connected to the first power circuit 320 to the remote switch device 200.

The remote switch device 200 includes a first port 211, a second port 212, a third port 213, a wireless module 230, a control unit 240, a power module 250, and a switch unit including a first switch module 260 and a second switch module 270.

The first port 211 is coupled to a first power terminal 321 of the first power circuit 320 through the external switch 310 when the external switch 310 conducts. The second port 212 is directly coupled to a second power terminal 322 of the first power circuit 320. The third port 213 is coupled to the second power circuit 330 through the load 100 by connection to a second terminal of the load 100. It is noted that the load 100 may be coupled to the second power circuit 330 by direct connection or through connection to the power module 250 of the remote switch device 200. The first and second power terminals 321, 322 may be either coupled together (i.e., being substantially the same terminal) or coupled to different circuit nodes of the first power circuit 320, and this disclosure is not limited thereto. Accordingly, a first path and a second path of the remote switch device 200 for transmission of electrical power provided by the electric power unit 300 are formed from the first power circuit 320 to the third port 213 through the first port 211, and from the first power circuit 320 to the third port 213 through the second port 212, respectively.

In this embodiment, the first and second switch modules 260, 270 are realized using electromagnetic relays, but this disclosure is not limited thereto. In other embodiments, the first and second switch modules 260, 270 may be realized using solid state relays (SSR), transistors, metal-oxide-semiconductor field effect transistor (MOSFET), integrated circuits, etc. Each of the first and second switch modules 260, 270 has a first terminal 261, 271, a second terminal 262, 272, a third terminal 263, 273, and a driver 264, 274. It is noted that the terms "NO", "COM" and "NC" shown in the drawings respectively refer to "normally-open terminal", "common terminal" and "normally-closed terminal", which are commonly used for electromagnetic relays.

Accordingly, in this embodiment, the terminal 261 is a normally-open terminal that is coupled to the second port 212, the terminal 262 is a common terminal that is coupled to the terminal 273, the terminal 263 is a normally-closed terminal that is floating, the terminal 271 is a normally-closed terminal that is coupled to the first port 211, the terminal 272 is a common terminal that is coupled to the third port 213, and the terminal 273 is a normally-open terminal. The drivers 264, 274 are individually controlled by the control unit 240 to switch between a magnetizing state in which the corresponding common and normally-open terminals are connected together, and a demagnetizing state in which the corresponding common and normally-close terminals are connected together.

The wireless module 230 receives the wireless control signal that is transmitted by the remote control device 400 and that indicates a switching operation, and outputs a switching signal according to the wireless control signal. It is noted that the remote control device 400 may be, for example, a smartphone, a tablet computer, etc., which outputs the wireless control signal via an application installed therein and a wireless transmitter (not shown), or a remote controller dedicated for the remote switch device 200, but this disclosure is not limited thereto. In addition, the wireless control signal may be, for example, a radio frequency signal, a Bluetooth signal, an infrared signal, WiFi, etc.

The control unit 240 includes a detecting module 241, and a processing module 242. The detecting module 241 is configured to detect an electrical signal (e.g., a voltage or a current) at a terminal of the external switch 310 opposite to the first power circuit 320, and to generate a detected signal associated with the state of the external switch 310 based on result of the detection. The processing module 242 is coupled to the detecting module 241 and the wireless module 230 for receiving the detected signal and the switching signal respectively, and is coupled to the first and second switch modules 260, 270 for controlling switching operations thereof. In a normal state (first operation state), the processing module 242 may control the drivers 264, 274 such that the first and second switch modules 260, 270 switch, upon any one of receipt of the switching signal and detection of switching of the external switch 310, from one of a conducting state and a non-conducting state to the other one of the conducting state and the non-conducting state such that one of the first and second paths conducts or both of the first and second paths conducts do not conduct. In the conducting state, the first and second switch modules 260, 270 establish electrical connection of one of the first and second paths, so that transmission of electrical power between the first and second power circuits 320, 330 through the first and second switch modules 260, 270 and the load 100 is permitted; and in the non-conducting state, the first and second switch modules 260, 270 break electrical connections of both of the first and second paths, so that transmission of electrical power between the first and second power circuits 320, 330 through the first and second switch modules 260, 270 is not permitted.

The power module 250 is coupled between the first and second power circuits 320, 330, and converts electrical power provided by the electric power unit 300 into electrical power for use by the wireless module 230 and the control unit 240. In this embodiment, the power module 250 converts alternating current (AC) power into direct current (DC) power for the wireless module 230 and the control unit 240. In a case that the wireless module 230 and the control unit 240 can directly use AC power, the power module 250 may be omitted.

Figure 10:
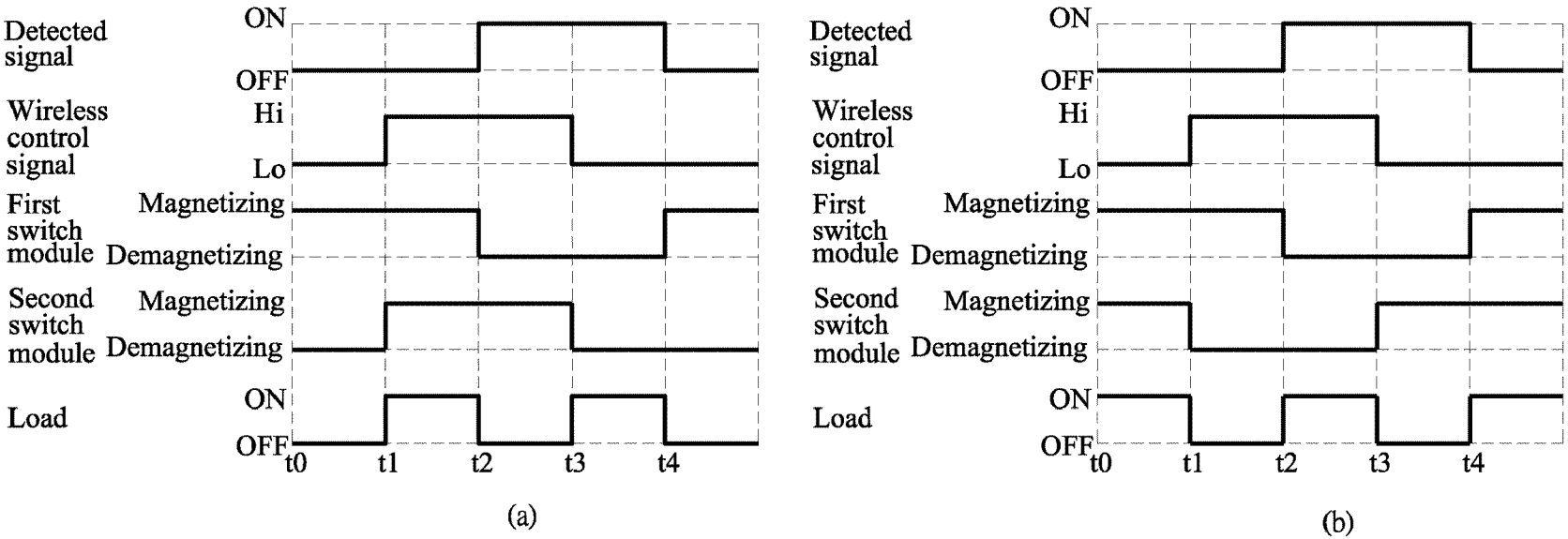
FIG. 10 illustrates operation of the first and second embodiments.

Referring to FIG. 10, the drawings (a) and (b) are timing diagrams that illustrate operations of the remote control electric device, and differ in the initial state of the second switch module 270. In the drawing (a) of FIG. 10, the second switch module 270 is in the demagnetizing state initially, causing the load 100 to be in an OFF state; and, in the drawing (b) of FIG. 10, the second switch module 270 is in the magnetizing state initially, causing the load 100 to be in an ON state. In practice, users may select either one of the initial states as required. As shown in FIG. 10, when either the detected signal that corresponds to the state of the external switch 310 or the wireless control signal that corresponds to user control through the remote control device 400 changes, the processing module 242 controls switching operations of the drivers 264, 274 to change a connection state between the first and second power circuits 320, 330 from ON to OFF, or from OFF to ON.

As shown the drawing (a) of FIG. 10, in the beginning (i.e., at the time (t0)), the external switch 310 is OFF (open), causing the detected signal to be low and the driver 264 to operate in the magnetizing state, and the wireless control signal is low, causing the driver 274 to operate in the demagnetizing state. Accordingly, the terminal 262 (COM) is coupled to the terminal 261 (NO), and the terminal 272 (COM) is coupled to the terminal 271 (NC), breaking electrical connections of both the first and second paths, and the load 100 is thus not in operation. At the time (t1) where the wireless control signal is switched to high, the processing module 242 detects the switching of the wireless control signal according to the switching signal, and controls the driver 274 to operate in the magnetizing state, such that the terminal 272 (COM) is coupled to the terminal 273 (NO), making electrical connection of the second path, and the load 100 is thus in operation. At the time (t2) where the external switch 310 is switched to ON (closed), the processing module 242 detects switching of the external switch 310 according to the detected signal, and controls the driver 264 to operate in the demagnetizing state, such that the terminal 262 (COM) is coupled to the terminal 263 (NC), breaking electrical connection of the second path, and the load 100 is thus not in operation. At the time (t3) where the wireless control signal is switched to low, the processing module 242 detects the switching of the wireless control signal according to the switching signal, and controls the driver 274 to operate in the demagnetizing state, such that the terminal 272 (COM) is coupled to the terminal 271 (NC), making electrical connection of the first path, and the load 100 is thus in operation. At the time (t4) where the external switch 310 is switched to OFF, electrical connection of the first path is broken, making the load 100 not in operation, and the processing module 242 detects switching of the external switch 310 according to the detected signal, and controls the driver 264 to operate in the magnetizing state, such that the terminal 262 (COM) is coupled to the terminal 261 (NO).

Operation shown in the drawing (b) of FIG. 10 is similar to that shown in the drawing (a), and details are thus not described herein for the sake of brevity. Accordingly, upon occurrence of any one of the switching of the wireless control signal and the switching of the external switch 310, the processing module 242 controls the first and second switch modules 260, 270 to switch from one of the conducting and non-conducting states to the other one of the conducting and non-conducting states.

It is noted that FIG. 10 illustrates operations of the remote switch device 200 in the normal state. When the remote switch device 200 is in an abnormal state (second operation state) in which for example, the control unit 240 malfunctions and is unable to control the drivers 264, 274, both of the drivers 264, 274 are in the demagnetizing state, so the terminal 262 (COM) is always coupled to the terminal 263 (NC), and the terminal 272 (COM) is always coupled to the terminal 271 (NC), and the electrical connection of the first path can still be controlled using the external switch 310. In other words, the user may still control on/off of the load 100 by operating the external switch 310.

Figure 2:
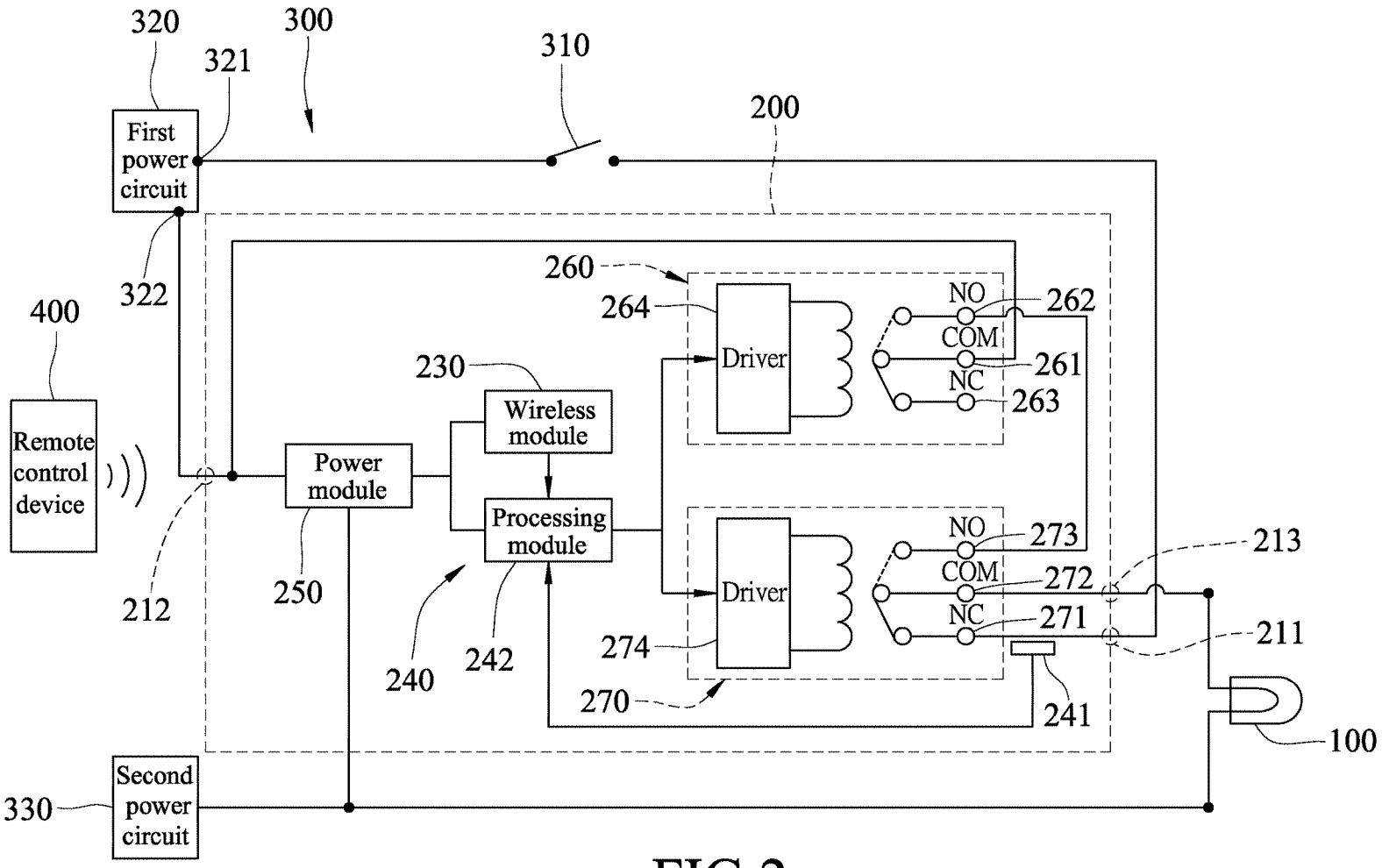

Referring to FIG. 2, the second embodiment of the remote switch device 200 according to this disclosure is shown to differ from the first embodiment in that, in this embodiment, the terminals 261, 262 are the common terminal and the normally-open terminal of the first switch module 260, respectively. Reference to FIG. 10 may also be made for operation of the second embodiment.

Figure 3:
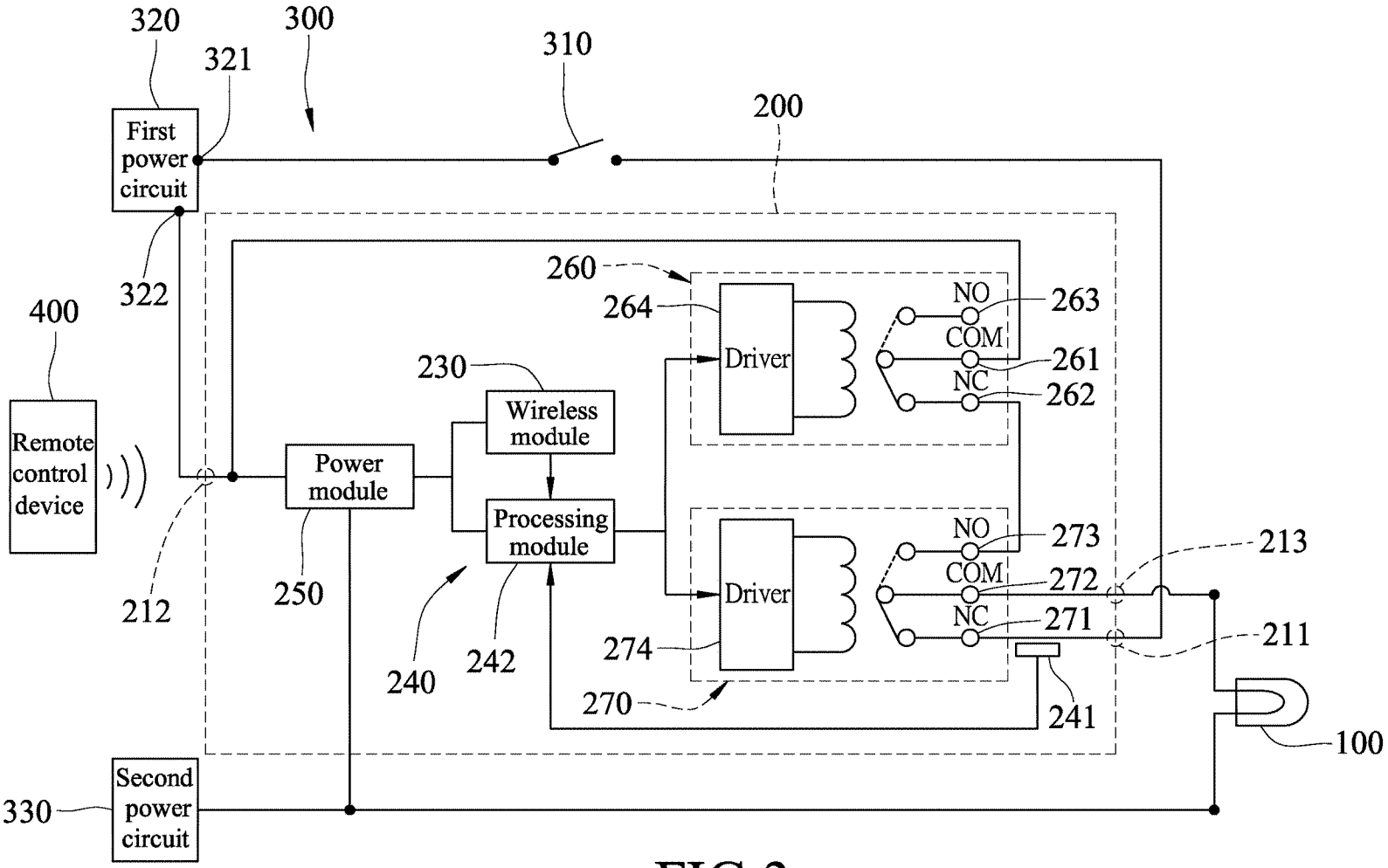

Referring to FIG. 3, the third embodiment of the remote switch device 200 according to this disclosure is shown to differ from the first embodiment in that, in this embodiment, the terminals 261, 262, 263 are the common terminal, the normally-closed terminal and the normally-open terminal of the first switch module 260, respectively.

Figure 4:
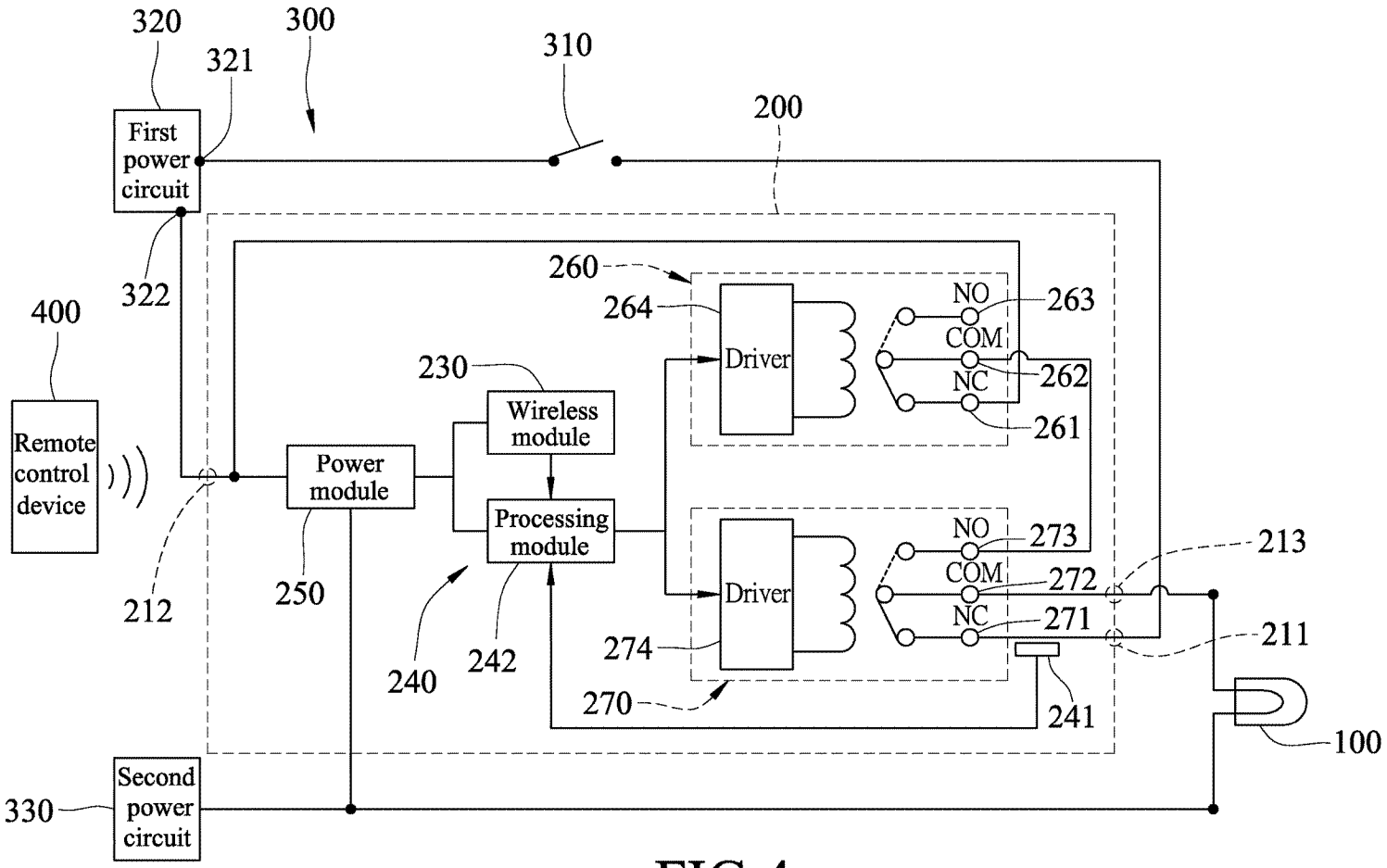
Figure 11:
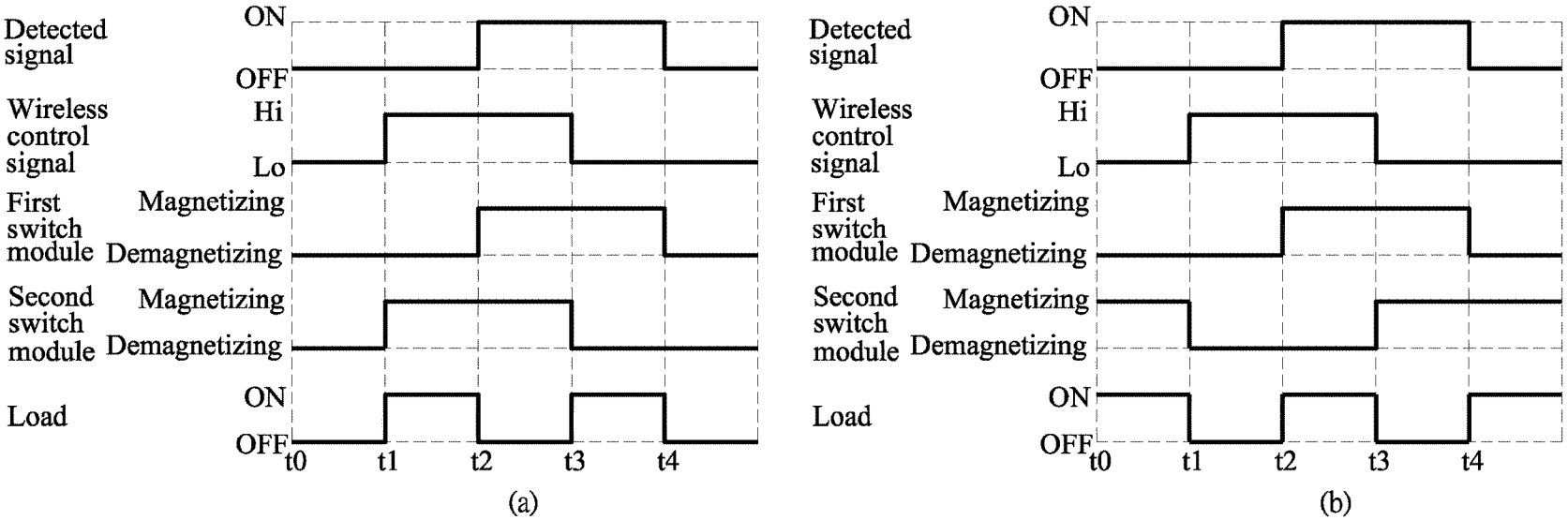
FIG. 11 illustrates operation of the third and fourth embodiments.

Referring to FIG. 4, the fourth embodiment of the remote switch device 200 according to this disclosure is shown to differ from the first embodiment in that, in this embodiment, the terminals 261, 263 are the normally-closed terminal and the normally-open terminal of the first switch module 260, respectively. Reference to FIG. 11 may be made for operations of the third and fourth embodiments.

Figure 5:
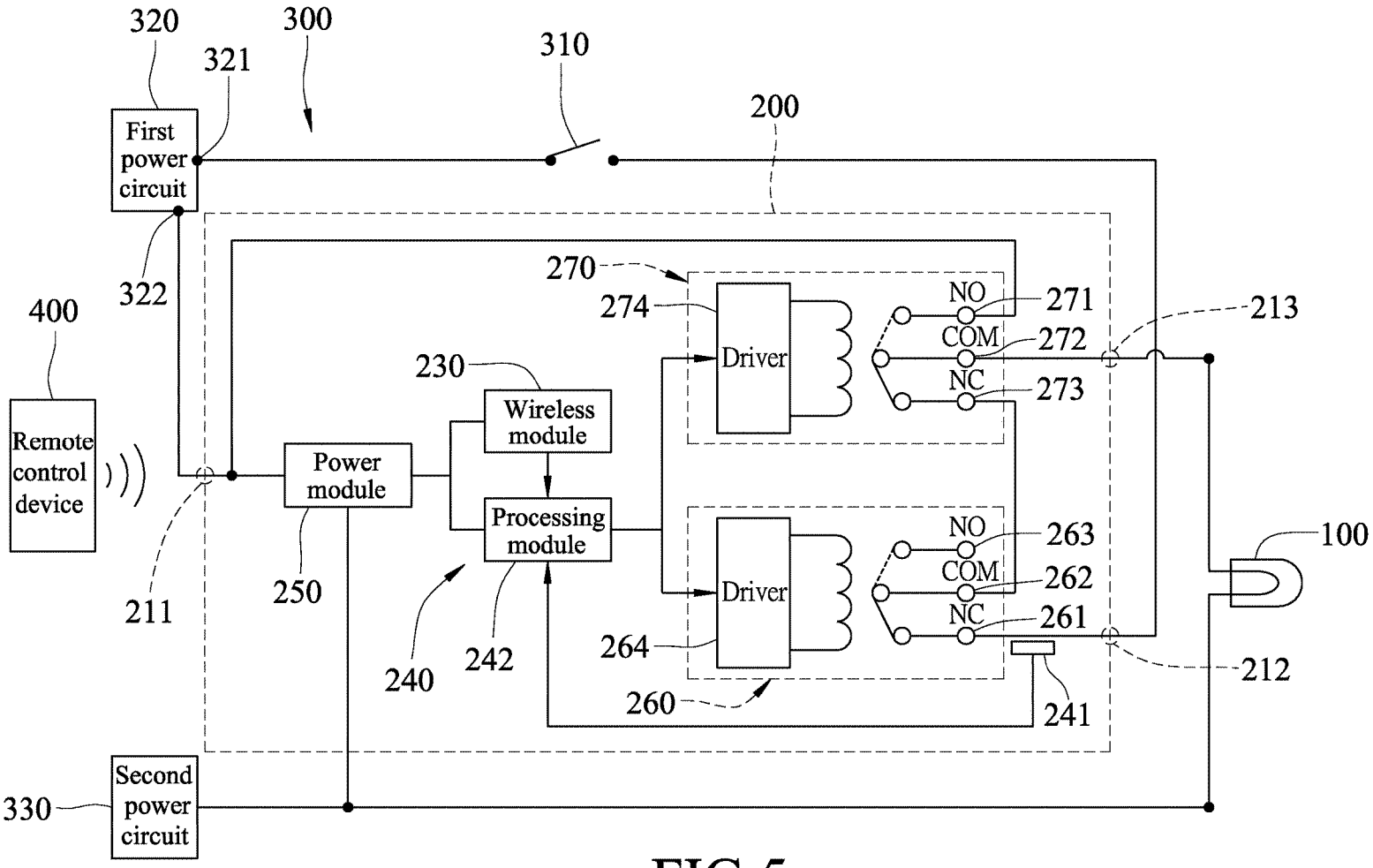

Referring to FIG. 5, the fifth embodiment of the remote switch device 200 according to this disclosure is shown to differ from the first embodiment in that, in this embodiment, the first port 211 is directly coupled to the first power circuit 320; the second port 212 is coupled to the first power circuit 320 through the external switch 310; the terminals 261, 263 are the normally-closed terminal and the normally-open terminal of the first switch module 260, respectively; and the terminals 271, 273 are the normally-open terminal and the normally-closed terminal of the second switch module 270, respectively.

Figure 6:
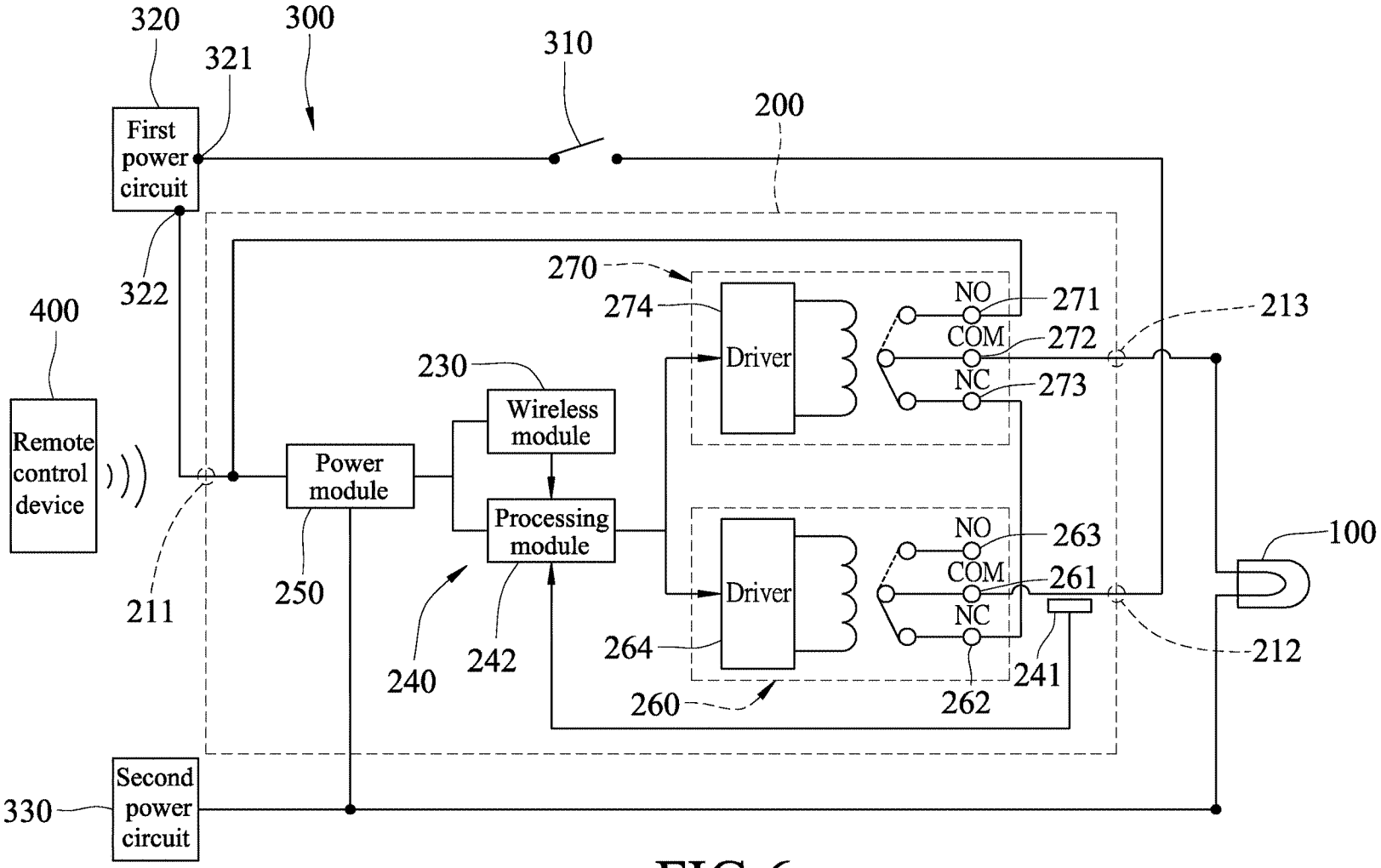
Figure 12:
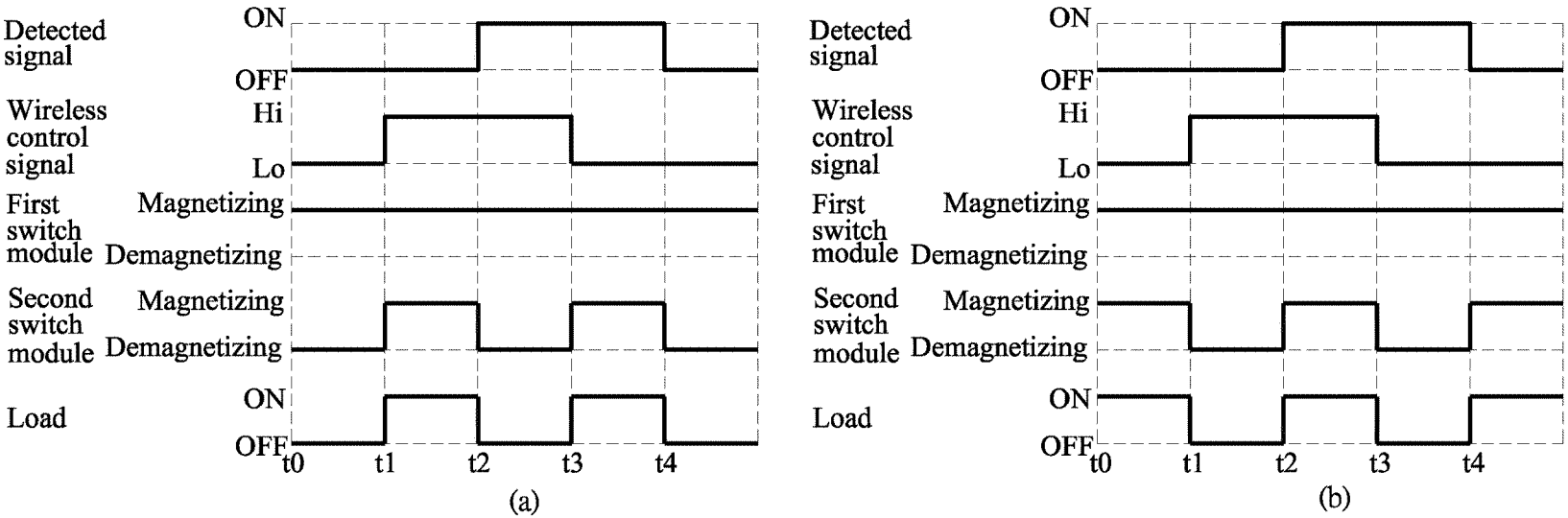
FIG. 12 illustrates operation of the fifth and sixth embodiments.

Referring to FIG. 6, the sixth embodiment of the remote switch device 200 according to this disclosure is shown to differ from the fifth embodiment in that, in this embodiment, the terminals 261, 262 are the common terminal and the normally-closed terminal of the first switch module 260, respectively. Reference to FIG. 12 may be made for operations of the fifth and sixth embodiments.

As shown in FIG. 12, when the remote switch device 200 operates in the normal state, the control unit 240 controls the driver 264 to always operate in the magnetizing state such that the common terminal is not coupled to the normally-closed terminal in the first switch module 260, and electrical connection of the second path is always broken. Upon occurrence of any one of the switching of the external switch 310 and the switching of the wireless control signal, the driver 274 is controlled by the control unit 240 to switch from one of the magnetizing state and the demagnetizing state to the other one of the magnetizing state and the demagnetizing state, thereby changing connection of the terminal 272 (COM) from one of the terminals 271, 273 (NO, NC) to the other one of the terminals 271, 273 (NO, NC), and making or breaking electrical connection between the first and second power circuits 320, 330. When the remote switch device 200 is in the abnormal state, both of the drivers 264, 274 are in the demagnetizing state, so the terminal 272 (COM) is not coupled to the terminal 271 (NO), breaking electrical connection of the first path, and the common terminal is coupled to the normally-closed terminal in the first switch module 260 (i.e., the terminals 261, 262 are coupled together). Accordingly, electrical connection of the second path can still be controlled using the external switch 310. In other words, the user may still control on/off of the load 100 by operating the external switch 310.

Figure 7:
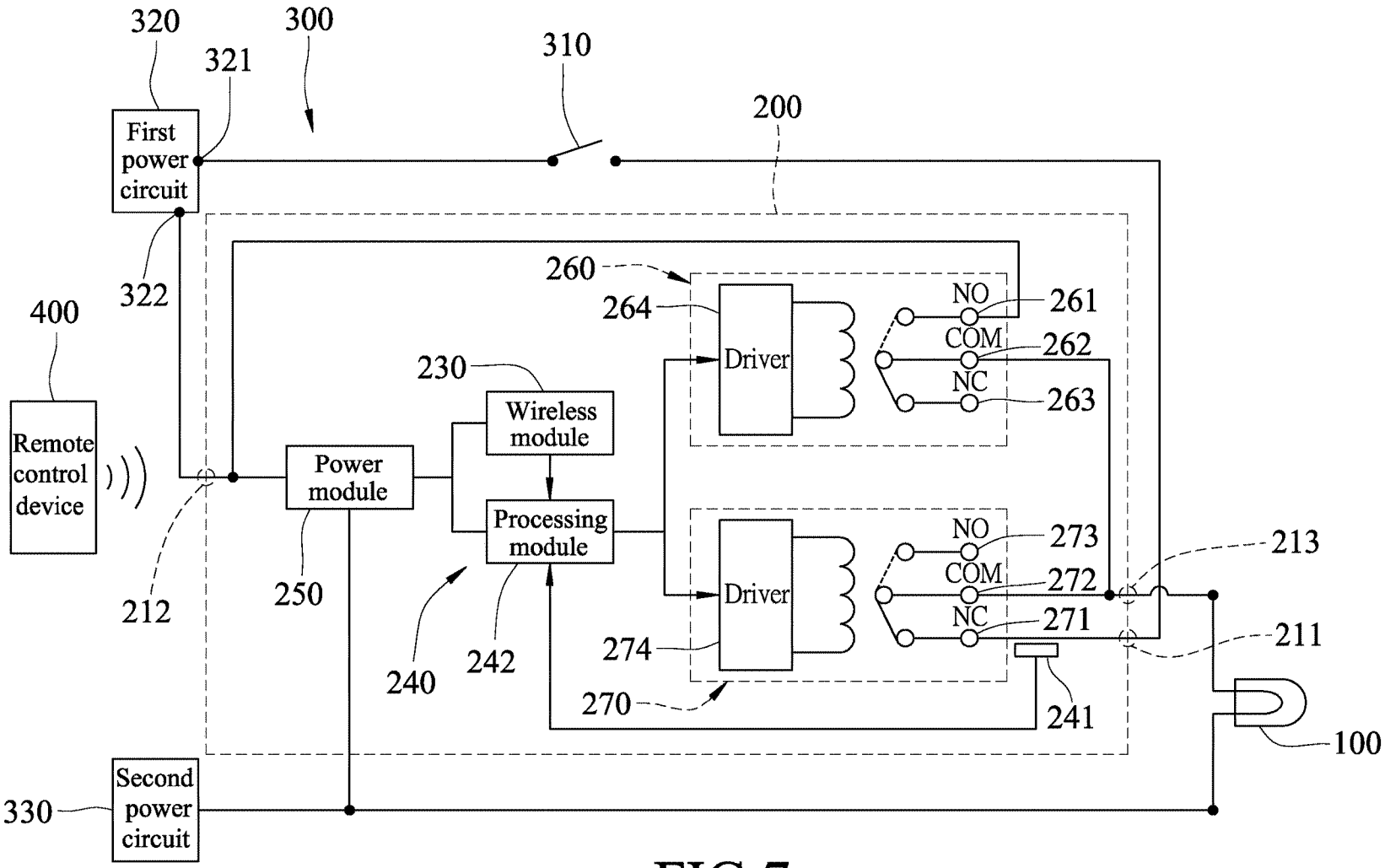
Figure 13:
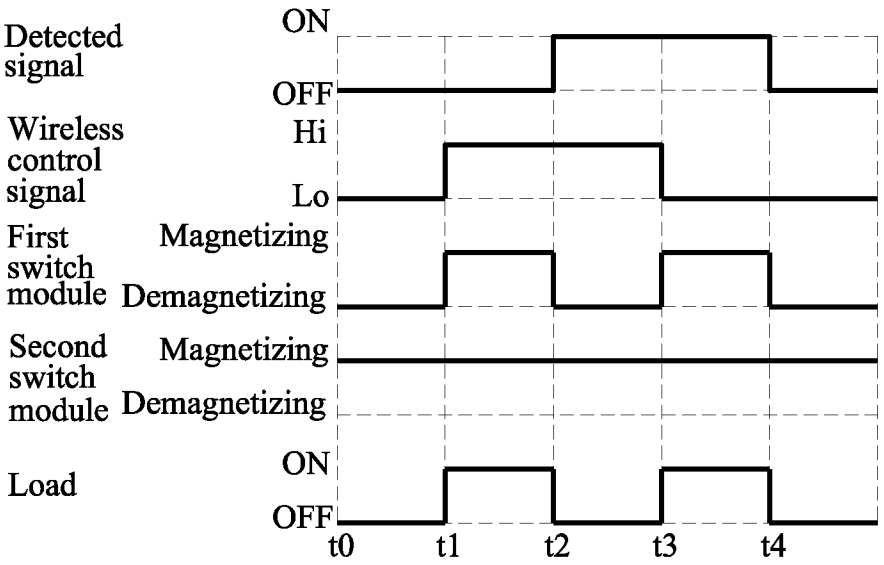
FIG. 13 illustrates operation of the seventh embodiment.

Referring to FIG. 7, the seventh embodiment of the remote switch device 200 according to this disclosure is shown to differ from the first embodiment in that, in this embodiment, the terminal 262 is coupled to the terminal 272, and the terminals 263, 273 are floating. Reference to FIG. 13 may be made for operation of the seventh embodiment.

As shown in FIG. 13, when the remote switch device 200 operates in the normal state, the control unit 240 controls the driver 274 to always operate in the magnetizing state such that the terminal 272 (COM) is not coupled to the terminal 271 (NC) in the second switch module 270, and electrical connection of the first path is always broken. Upon occurrence of any one of the switching of the external switch 310 and the switching of the wireless control signal, the driver 264 is controlled by the control unit 240 to switch from one of the magnetizing state and the demagnetizing state to the other one of the magnetizing state and the demagnetizing state, thereby changing connection of the terminal 262 (COM) from one of the terminals 261, 263 (NO, NC) to the other one of the terminals 261, 263 (NO, NC), and making or breaking electrical connection between the first and second power circuits 320, 330. When the remote switch device 200 is in the abnormal state, both of the drivers 264, 274 are in the demagnetizing state, so the terminal 262 (COM) is not coupled to the terminal 261 (NO), breaking electrical connection of the second path, and the terminal 272 (COM) is coupled to the terminal 271 (NC) in the second switch module 270. Accordingly, electrical connection of the first path can still be controlled using the external switch 310. In other words, the user may still control on/off of the load 100 by operating the external switch 310.

Figure 8:
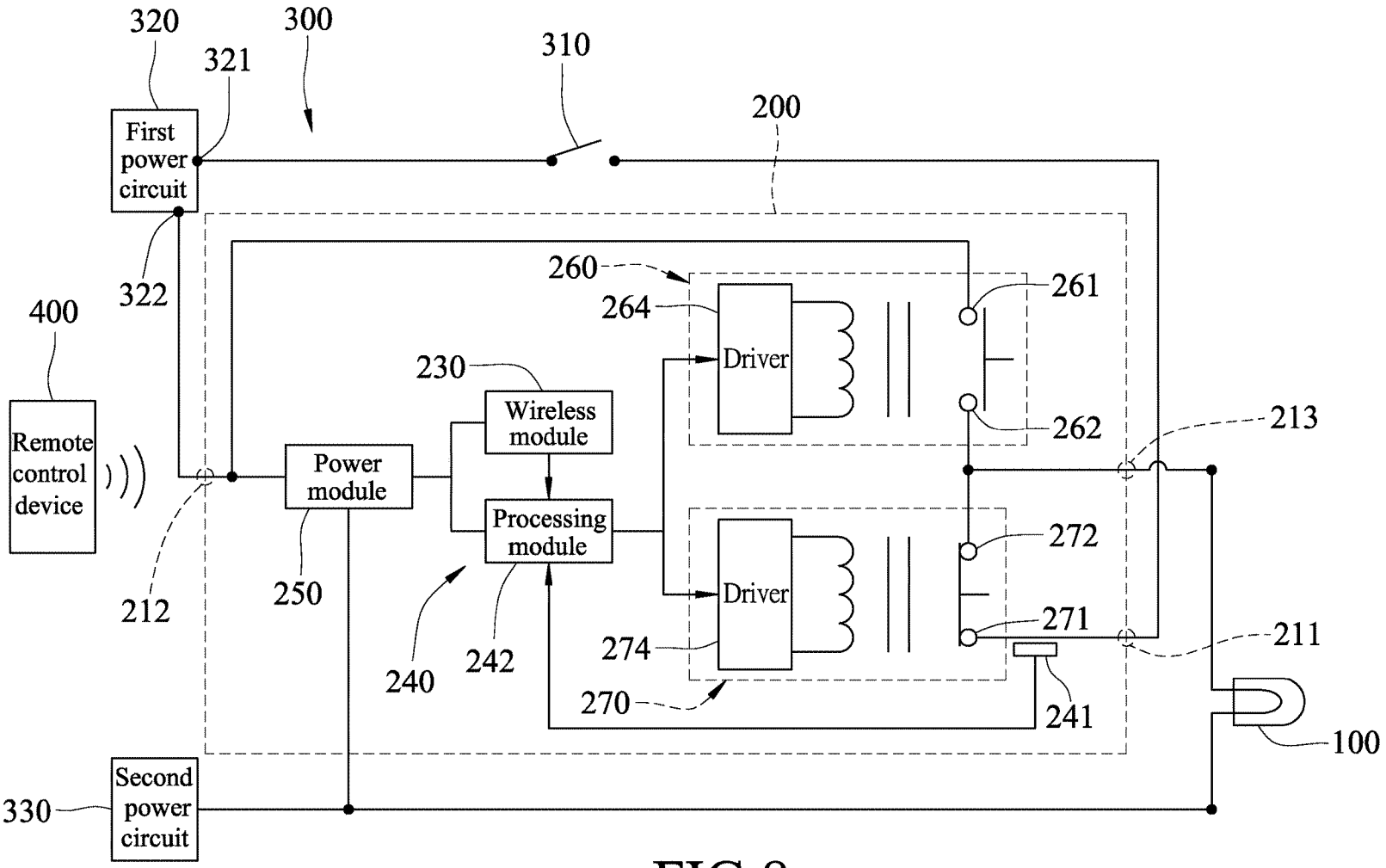
FIG. 8 is a circuit block diagram illustrating a variation of the seventh embodiment.

Referring to FIG. 8, a variation of the seventh embodiment is shown that the first switch module 260 is realized using an automatic switch that is normally-open, and the second switch module 270 is realized using an automatic switch that is normally-closed. Accordingly, when the remote switch device 200 operates in the normal state, the control unit 240 controls the driver 274 to always operate in the magnetizing state such that the terminal 272 is not coupled to the terminal 271 in the second switch module 270, and electrical connection of the first path is always broken. Upon occurrence of any one of the switching of the external switch 310 and the switching of the wireless control signal, the driver 264 is controlled by the control unit 240 to switch from one of the magnetizing state and the demagnetizing state to the other one of the magnetizing state and the demagnetizing state, thereby making or breaking electrical connection between the terminals 261, 262. When the remote switch device 200 is in the abnormal state, both of the drivers 264, 274 are in the demagnetizing state, so the terminal 262 is not coupled to the terminal 261, breaking electrical connection of the second path, and the terminals 271, 272 are coupled together. Accordingly, electrical connection of the first path can still be controlled using the external switch 310.

Figure 9:
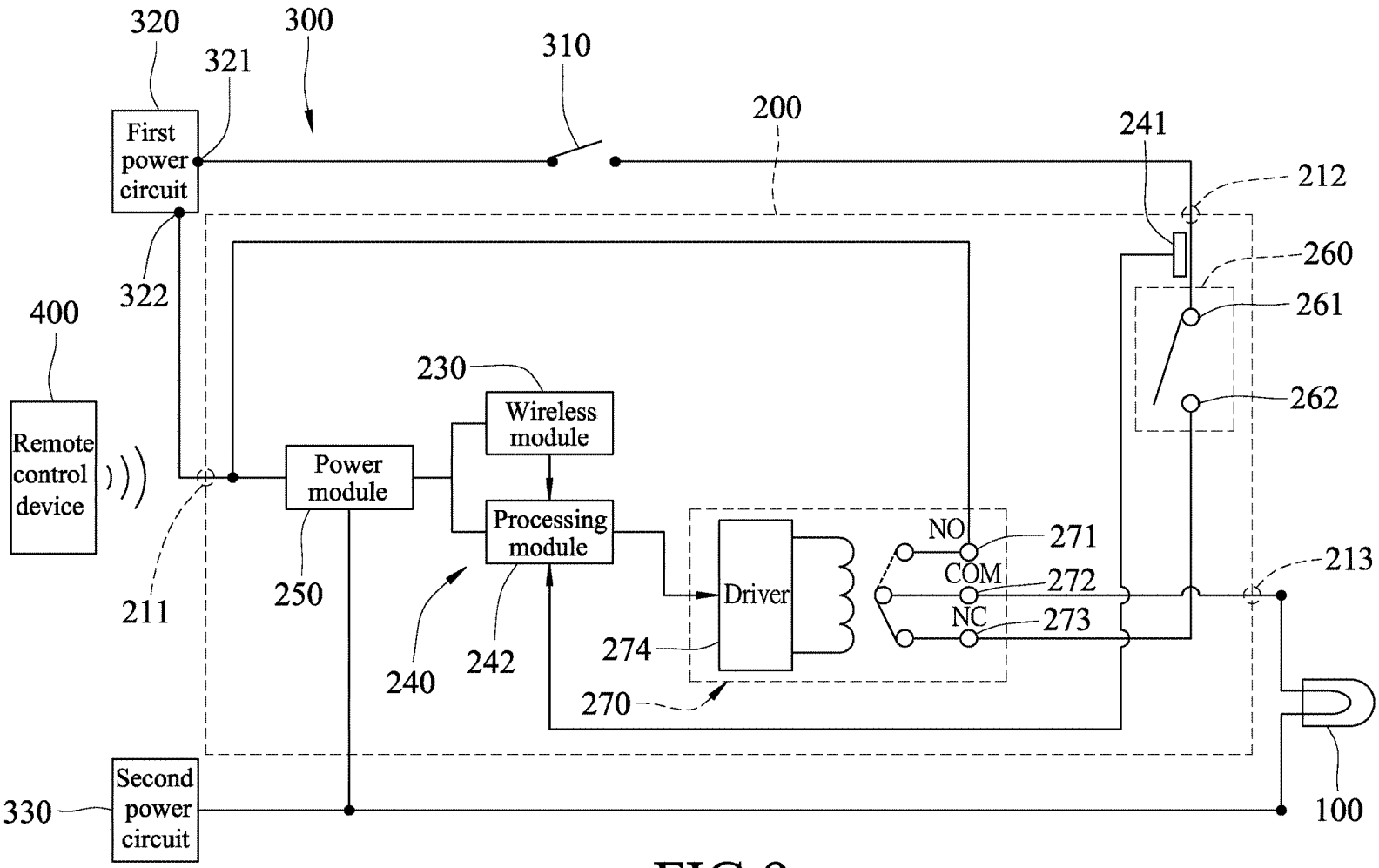
FIG. 9 is a circuit block diagram illustrating a variation of the sixth embodiment.

In the first to seventh embodiments, the first and second switch modules 260, 270 are both realized using electrically operated switches. However, the first switch module 260 may be realized using a manually operated switch. FIG. 9 illustrates a variation of the sixth embodiment in which the first switch module 260 is realized using a manually operated switch. It is noted that the manually operated switch is not limited to be operated by hand, and may be operated by remote control. When the remote switch device 200 operates in the normal state, the first switch module 260 is always left open such that electrical connection of the first path is always broken. Upon occurrence of anyone of the switching of the external switch 310 and the switching of the wireless control signal, the driver 274 is controlled by the control unit 240 to switch from one of the magnetizing state and the demagnetizing state to the other one of the magnetizing state and the demagnetizing state, thereby changing connection of the terminal 272 (COM) from one of the terminals 271, 273 (NC, NO) to the other one of the terminals 271, 273 (NC, NO), and making or breaking electrical connection between the first and second power circuits 320, 330. When the remote switch device 200 is in the abnormal state, the driver 274 is in the demagnetizing state, so the terminal 272 is not coupled to the terminal 273, breaking electrical connection of the second path. In this situation, the user may close the manually operated switch of the first switch module 260 such that the terminals 261, 262 are coupled together. As a result, electrical connection of the first path can still be controlled using the external switch 310.

Figure 14:
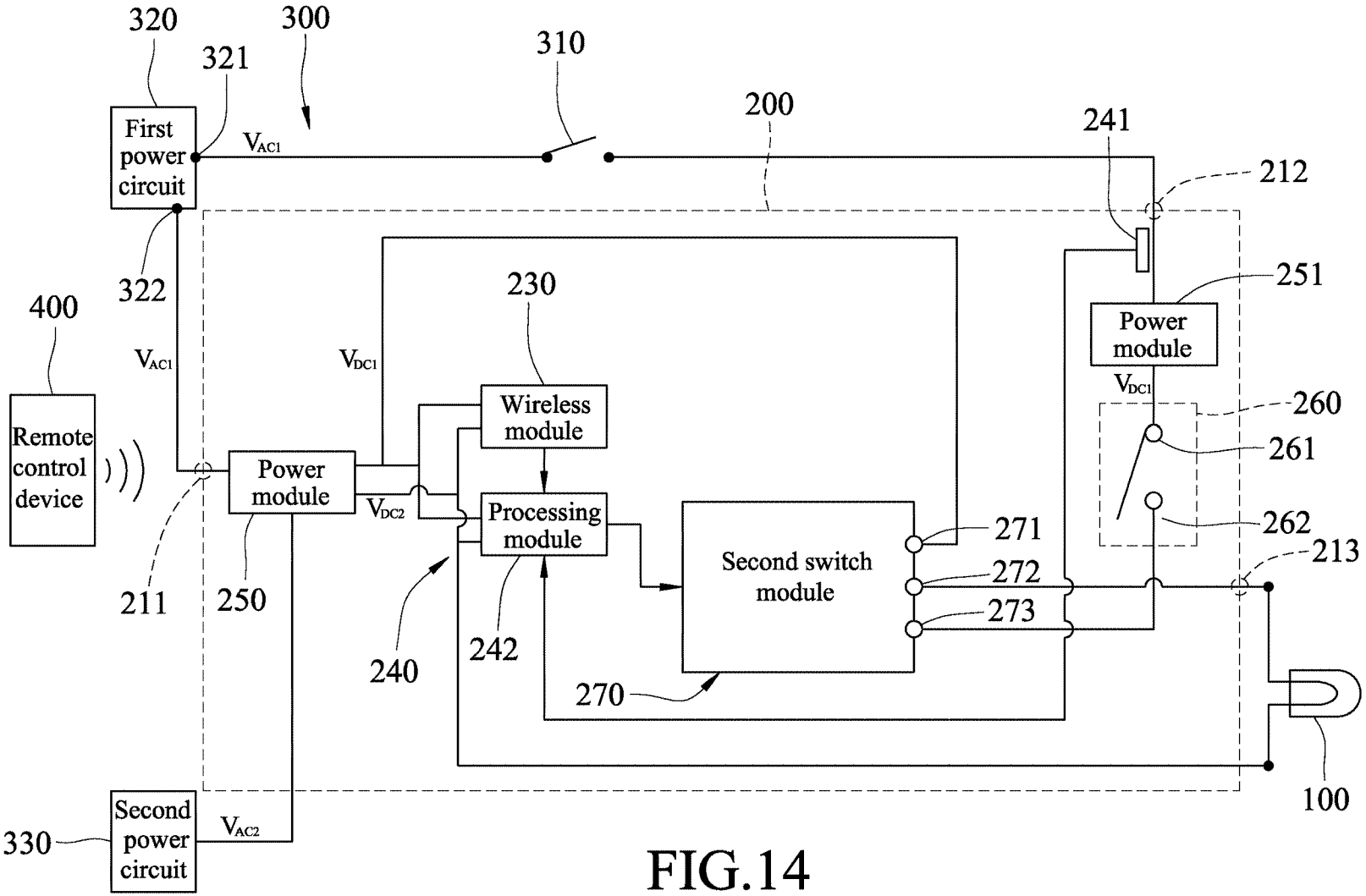
FIG. 14 is a circuit block diagram illustrating a modification of the variation depicted in FIG. 9.

Referring to FIG. 14, a modification of the configuration depicted in FIG. 9 is shown that the second switch module 270 is realized using circuit components with small operating voltages (e.g., transistors). Accordingly, the power module 250 may be configured to perform AC-to-DC voltage conversion and voltage step-down conversion on the AC voltages ($V_{AC1}$, $V_{AC2}$) provided by the first and second power circuits 320, 330, thereby acquiring DC voltages ($V_{DC1}$, $V_{DC2}$) for operation of the second switch module 270. In this modification, the remote control electric device further includes another power module 251 for performing AC-to-DC voltage conversion and voltage step-down conversion on the AC voltage ($V_{AC1}$) received from the external switch 310 to acquire the DC voltage ($V_{DC1}$); the terminal 261 is indirectly coupled to the second port 212 via the power module 251, the terminal 271 is indirectly coupled to the first port 211 via the power module 250, and the load 100 is indirectly coupled to the second power circuit 330 via the power module 250. By such configuration, the modification may achieve the same effect as that of the configuration shown in FIG. 9 while using circuit components with small operating voltages. It is noted that, in a case that the first and power circuits 320, 330 directly provide small DC voltages that conform with the operating voltages of the circuit components, the power modules 250, 251 may be omitted.

In summary, by virtue of the first and second switch modules 260, 270, the load 100 may be turned on/off upon occurrence of any one of the switching of the external switch 310 and the switching of the wireless control signal. In addition, even if the remote control device 200 malfunctions, users may still be able to control on/off of the load 100 through the external switch 310.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A remote switch device comprising:

a first port and a second port, one of which is to be coupled to a first power circuit through an external switch when the external switch conducts, and the other one of which is to be coupled to the first power circuit;

a third port to be coupled to a second power circuit through a load;

a switch unit including a first switch module coupled to said second port; and a second switch module coupled to said first port, said third port and said first switch module;

a wireless module configured to receive a wireless control signal that indicates a switching operation, and to output a switching signal according to the wireless control signal; and a control unit coupled to said wireless module for receiving the switching signal, coupled to at least said second switch module for controlling switching operation thereof, and configured to detect a state of the external switch;

wherein, when said remote switch device is in a first operation state, said control unit controls said switch unit to switch, upon any one of receipt of the switching signal and detection of switching of the external switch, from one of a conducting state and a non-conducting state to the other one of the conducting state and the non-conducting state;

wherein, in the conducting state, said switch unit is controlled by said control unit to permit transmission of electrical power between the first and second power circuits through said first and second switch modules and the load; and wherein, in the non-conducting state, said switch unit is controlled by said control unit to not permit transmission of electrical power between the first and second power circuits therethrough.

2. The remote switch device of claim 1, wherein said control unit is further coupled to said first switch module for controlling switching operation thereof;

said first switch module having a first terminal coupled to said second port, and a second terminal; and said second switch module having a first terminal coupled to said first port, a second terminal coupled to said third port, and a third terminal coupled to said second terminal of said first switch module.

3. The remote switch device of claim 2, wherein said first switch module is controlled by said control unit to make or break electrical connection between said first and second terminals thereof, and said second switch module is controlled by said control unit to electrically connect said second terminal thereof to one of said first and third terminals thereof.

4. The remote switch device of claim 3, wherein said first port is to be coupled to the first power circuit through the external switch, and said second port is to be coupled to the first power circuit;

wherein, when said remote switch device is in the first operation state, said control unit controls said first switch module to break electrical connection between said first and second terminals thereof upon detecting that the external switch conducts, controls said first switch module to make electrical connection between said first and second terminals thereof upon detecting that the external switch does not conduct, and controls said second switch module to electrically connect said second terminal thereof to the other one of said first and third terminals thereof upon receipt of the switching signal; and wherein, when said remote switch device is in a second operation state, said second switch module always electrically connects said second terminal thereof to said first terminal thereof.

5. The remote switch device of claim 3, wherein said first port is to be coupled to the first power circuit, and said second port is to be coupled to the first power circuit through the external switch;

wherein, when said remote switch device is in the first operation state, said control unit controls said first switch module to break electrical connection between said first and second terminals thereof, and controls said second switch module to electrically connect said second terminal thereof to the other one of said first and third terminals thereof upon any one of receipt of the switching signal and detection of switching of the external switch; and wherein, when said remote switch device is in a second operation state, said first switch module always makes electrical connection between said first and second terminals thereof, and said second switch module always electrically connects said second terminal thereof to said third terminal thereof.

6. The remote switch device of claim 1, wherein said control unit is further coupled to said first switch module for controlling switching operation thereof;

said first switch module has a first terminal coupled to said second port, and a second terminal; and said second switch module has a first terminal coupled to said first port, and a second terminal coupled to said third port and said second terminal of said first switch module.

7. The remote switch device of claim 6, wherein said first port is to be coupled to the first power circuit through the external switch, and said second port is to be coupled to the first power circuit;

wherein, when said remote switch device is in the first operation state, said control unit controls said second switch module to break electrical connection between said first and second terminals thereof, and controls said first switch module to change a state of electrical connection between said first and second terminals thereof upon any one of receipt of the switching signal and detection of switching of the external switch; and wherein, when said remote switch device is in a second operation state, said second switch module always makes electrical connection between said first and second terminals thereof, and said first switch module always breaks electrical connection between said first and second terminals thereof.

8. The remote switch device of claim 1, wherein said control unit is further coupled to said first switch module for controlling switching operation thereof;

wherein, in the conducting state, said first and second switch module establish electrical connection of one of a first path from the first power circuit to said third port through said first port, and a second path from the first power circuit to said third port through said second port; and wherein, in the non-conducting state, said first and second switch module break electrical connections of both of the first and second paths.

9. The remote switch device of claim 1, wherein said control unit includes:

a detecting module configured to detect an electrical signal at a terminal of the external switch opposite to the first power circuit, and to generate a detected signal associated with the state of the external switch; and a processing module coupled to said detecting module and said wireless module for receiving the detected signal and the switching signal respectively, and coupled to at least said second switch module for controlling switching operations thereof.

10. The remote switch device of claim 1, wherein said switch unit are configured such that, when said remote switch device is in a second operation state where said control unit does not control switching operations of said first and second switch module, said switch unit always permits transmission of electrical power that is received from the external switch therethrough.

11. The remote switch device of claim 1, wherein said first port is to be coupled to the first power circuit, and said second port is to be coupled to the first power circuit through the external switch when the external switch conducts;

wherein said first switch module is a manually operated switch module having a first terminal coupled to said second port, and a second terminal;

wherein said second switch module is an electrically operated switch module having a first terminal coupled to said first port, a second terminal coupled to said third port, and a third terminal coupled to said second terminal of said first switch module;

wherein, when said remote switch device is in the first operation state where said first switch module breaks electrical connection between said first and second terminals thereof and said control unit controls switching operation of said second switch module, said control unit controls said second switch module to switch, upon any one of receipt of the switching signal and detection of switching of the external switch, from one of the conducting state and the non-conducting state to the other one of the conducting state and the non-conducting state;

wherein, in the conducting state, said second switch module is controlled by said control unit to connect said second terminal thereof to said first terminal thereof;

wherein, in the non-conducting state, said second switch module is controlled by said control unit to connect said second terminal thereof to said third terminal thereof;

wherein, when said remote switch device is in a second operation state where said manual switch module makes electrical connection between said first and second terminals thereof, said second switch module always connects said second terminal thereof to said third terminal thereof.

12. The remote switch device of claim 1, further comprising the external switch.

13. A remote control electric device adapted to be removably coupled to an electric power unit that includes an external switch, a first power circuit coupled to the external switch, and a second power circuit, said remote control electric device comprising:

a remote switch device part configured as said remote switch device of claim 1; and an electric device part having a first terminal to be coupled to the second power circuit, and a second terminal coupled to said third port of said remote switch device part, and serving as the load of claim 1.

14. The remote control electric device of claim 13, wherein: said control unit is further coupled to said first switch module for controlling switching operation thereof;

said first switch module has a first terminal coupled to said second port, and a second terminal; and said second switch module has a first terminal coupled to said first port, a second terminal coupled to said third port, and a third terminal coupled to said second terminal of said first switch module.

15. The remote control electric device of claim 14, wherein said first switch module is controlled by said control unit to make or break electrical connection between said first and second terminals thereof, and said second switch module is controlled by said control unit to electrically connect said second terminal thereof to one of said first and third terminals thereof.

16. The remote control electric device of claim 15, wherein said first port is to be coupled to the first power circuit through the external switch, and said second port is to be coupled to the first power circuit;

wherein, when said remote switch device is in the first operation state, said control unit controls said first switch module to break electrical connection between said first and second terminals thereof upon detecting that the external switch conducts, controls said first switch module to make electrical connection between said first and second terminals thereof upon detecting that the external switch does not conduct, and controls said second switch module to electrically connect said second terminal thereof to the other one of said first and third terminals thereof upon receipt of the switching signal; and wherein, when said remote switch device is in a second operation state, said second switch module always electrically connects said second terminal thereof to said first terminal thereof.

17. The remote control electric device of claim 15, wherein said first port is to be coupled to the first power circuit, and said second port is to be coupled to the first power circuit through the external switch;

wherein, when said remote switch device is in the first operation state, said control unit controls said first switch module to break electrical connection between said first and second terminals thereof, and controls said second switch module to electrically connect said second terminal thereof to the other one of said first and third terminals thereof upon any one of receipt of the switching signal and detection of switching of the external switch; and wherein, when said remote switch device is in a second operation state, said first switch module always makes electrical connection between said first and second terminals thereof, and said second switch module always electrically connects said second terminal thereof to said third terminal thereof.

18. The remote control electric device of claim 13, wherein: said control unit is further coupled to said first switch module for controlling switching operation thereof;

said first switch module has a first terminal coupled to said second port, and a second terminal; and said second switch module has a first terminal coupled to said first port, and a second terminal coupled to said third port and said second terminal of said first switch module.

19. The remote control electric device of claim 18, wherein said first port is to be coupled to the first power circuit through the external switch, and said second port is to be coupled to the first power circuit;

wherein, when said remote switch device is in the first operation state, said control unit controls said second switch module to break electrical connection between said first and second terminals thereof, and controls said first switch module to change a state of electrical connection between said first and second terminals thereof upon any one of receipt of the switching signal and detection of switching of the external switch; and wherein, when said remote switch device is in a second operation state, said second switch module always makes electrical connection between said first and second terminals thereof, and said first switch module always breaks electrical connection between said first and second terminals thereof.

20. The remote control electric device of claim 13, wherein said first port is to be coupled to the first power circuit, and said second port is to be coupled to the first power circuit through the external switch when the external switch conducts;

wherein said first switch module is a manually operated switch module having a first terminal coupled to said second port, and a second terminal;

wherein said second switch module is an electrically operated switch module having a first terminal coupled to said first port, a second terminal coupled to said third port, and a third terminal coupled to said second terminal of said first switch module;

wherein, when said remote switch device is in the first operation state where said first switch module breaks electrical connection between said first and second terminals thereof and said control unit controls switching operation of said second switch module, said control unit controls said second switch module to switch, upon any one of receipt of the switching signal and detection of switching of the external switch, from one of the conducting state and the non-conducting state to the other one of the conducting state and the non-conducting state;

wherein, in the conducting state, said second switch module is controlled by said control unit to connect said second terminal thereof to said first terminal thereof;

wherein, in the non-conducting state, said second switch module is controlled by said control unit to connect said second terminal thereof to said third terminal thereof; and wherein, when said remote switch device is in a second operation state where said manual switch module makes electrical connection between said first and second terminals thereof, said second switch module always connects said second terminal thereof to said third terminal thereof.

* * * * *